US012084241B2

(12) United States Patent
Amanat

(10) Patent No.: US 12,084,241 B2
(45) Date of Patent: Sep. 10, 2024

(54) TAMPER-EVIDENT SEALS FOR CONTAINERS

(71) Applicant: Sue Ellen Amanat, Chesterfield, MO (US)

(72) Inventor: Sue Ellen Amanat, Chesterfield, MO (US)

( * ) Notice: Subject to any disclaimer, the term of this patent is extended or adjusted under 35 U.S.C. 154(b) by 8 days.

(21) Appl. No.: 17/548,882

(22) Filed: Dec. 13, 2021

(65) Prior Publication Data

US 2023/0182978 A1 Jun. 15, 2023

(51) Int. Cl.

| | |
|---|---|
| ***B65D 55/02*** | (2006.01) |
| ***B65B 7/01*** | (2006.01) |
| ***B65B 7/28*** | (2006.01) |
| ***B65D 53/04*** | (2006.01) |

(52) U.S. Cl.

CPC ..... *B65D 55/026* (2013.01); *B65B 7/01* (2013.01); *B65B 7/2842* (2013.01); *B65D 53/04* (2013.01)

(58) Field of Classification Search

CPC ..... B65D 55/026; B65D 7/01; B65D 53/04; B65D 51/228; B65D 55/02; B65D 51/22; B65D 43/023; B65B 7/2842; A65D 51/22; A61J 3/072

USPC ..... 220/265

See application file for complete search history.

(56) References Cited

U.S. PATENT DOCUMENTS 587,368 A * 8/1897 JAckson ..... B65D 41/62 215/251
3,130,056 A * 4/1964 Taylor ..... B65D 41/42 426/106
3,249,252 A * 5/1966 Smith ..... A47L 15/4251 220/359.4
3,260,395 A * 7/1966 Ellis ..... B65D 41/42 D9/438
3,338,445 A * 8/1967 Lange ..... B65D 41/42 222/541.9
3,358,873 A * 12/1967 Eleaizer ..... B65D 17/4011 220/270
3,363,798 A * 1/1968 Garangiotis ..... B65D 17/4012 220/259.5
3,424,338 A * 1/1969 Kazel ..... B65D 17/4014 D9/438

(Continued)

FOREIGN PATENT DOCUMENTS

| | | |
|---|---|---|
| GB | 2234741 A | 2/1991 |
| WO | 2013134665 A1 | 9/2013 |

*Primary Examiner* — Ernesto A Grano
*Assistant Examiner* — Symren K Sanghera
(74) *Attorney, Agent, or Firm* — Armstrong Teasdale LLP

(57) ABSTRACT

A tamper-evident seal for use with a container includes a body that is sealably coupled to a boundary defining an opening providing access into the container. The seal includes a gripping portion having a fixed end and a free end, the fixed end extending from the body, wherein the free end is sized and shaped to be gripped by a user to enable the user to forcibly disconnect at least a portion of the body from the container. The seal further includes an indicator including an indicator body, a neck portion of the indicator is removably coupled to the gripping portion, such that when the body is at least partially removed from the boundary, at least a portion of the indicator body remains connected to the body, as the gripping portion is disconnected from the indicator when the neck portion is uncoupled from the gripping portion.

16 Claims, 7 Drawing Sheets

(56) References Cited

U.S. PATENT DOCUMENTS 3,435,977 A * 4/1969 Jacke ..... B65D 41/42 222/541.9
3,460,701 A * 8/1969 Powalowski ..... B65D 51/145 215/253
4,126,245 A * 11/1978 Baroody ..... B65D 77/32 220/279
4,227,619 A 10/1980 Magnusson
4,339,053 A * 7/1982 Tarro ..... B65D 55/02 220/269
4,432,462 A * 2/1984 Newkirk ..... B65D 55/026 215/230
RE31,869 E * 4/1985 Harding ..... B65D 41/44 215/254
4,719,740 A 1/1988 Gach
4,723,391 A 2/1988 Ashley et al.
4,960,216 A 10/1990 Giles
5,004,111 A 4/1991 McCarthy
5,217,307 A * 6/1993 McClintock ..... B65D 33/34 229/80.5
5,265,745 A 11/1993 Pereyra et al.
5,341,948 A 8/1994 Gaeta
5,860,544 A 1/1999 Brucker
5,931,332 A 8/1999 Mygatt et al.
6,254,139 B1 * 7/2001 Fresnel ..... G09F 3/0341 283/94
6,908,001 B2 * 6/2005 Moore ..... B65D 51/20 215/349
8,225,954 B1 * 7/2012 Triquet ..... B65D 77/2044 220/254.1
9,156,584 B2 10/2015 Ban et al.
9,656,780 B1 5/2017 Crawford
9,878,837 B2 1/2018 Veternik et al.
10,945,508 B2 3/2021 Wei
10,954,032 B2 3/2021 Thorstensen-Woll
2005/0017005 A1 * 1/2005 Nomula ..... B65D 17/4012 220/254.1
2006/0054584 A1 3/2006 Jackman
2011/0126675 A1 * 6/2011 Ferraro ..... B65D 41/325 81/3.07
2012/0000910 A1 * 1/2012 Ekkert ..... B65D 53/08 220/378
2012/0312818 A1 * 12/2012 Ekkert ..... B65D 41/045 220/258.2
2014/0061198 A1 * 3/2014 Seguin ..... B65D 53/04 220/378
2014/0312039 A1 * 10/2014 Abegglen ..... B65D 51/228 220/258.2
2015/0203245 A1 * 7/2015 Gayer ..... B65B 7/2842 53/329
2015/0251825 A1 * 9/2015 Larsson ..... B65D 51/20 220/258.2
2015/0321808 A1 * 11/2015 Thorstensen-Woll ..... B65D 51/20 215/232
2018/0105335 A1 * 4/2018 Roucou ..... B65D 55/026
2019/0202612 A1 * 7/2019 Chisholm ..... B65D 55/026

* cited by examiner

TAMPER-EVIDENT SEALS FOR CONTAINERS

BACKGROUND OF THE INVENTION

This application relates generally to tamper-evident seals used with containers and, more particularly, to a tamper-evident seal having a tamper evident gripping portion.

To assure customers that various products have not been tampered with prior to use by the consumer, the mouths of at least some known containers used to store such products have been sealed. Products that include such seals include commercial products ingested by humans, pharmaceuticals, medications, nasal sprays, motor oils, anti-freezes, insecticides, and/or solvents, for example. The seals, known as "tamper-proof seals" or "tamper evident seals," are typically fabricated from a membrane and/or a thin foil-like material that is secured by an adhesive or a heat seal about the periphery of the container mouths.

The seals are generally removed from the containers by the consumers to provide access to the contents held within the containers. Typically to remove such a tamper-evident seal, the consumer peals away the seal from the mouth of the container. At least some known seals include a gripping portion that provides a user with a mechanism to grab and pull the seal away from the container. In some known containers, the seal may be fully removed. In other known containers the seal may only be partially removed. In either seal configuration, a seal may be reattached to the container using adhesives in a manner that provides only minimal indication or no indication that the seal had been tampered with. Stated another way, known seals may be lifted, at least partially from the container rim, and then resealed with little to no indication that the seal had been tampered.

BRIEF DESCRIPTION OF THE INVENTION

In one embodiment, the present disclosure provides a tamper-evident seal for use with a container including a body that is sealably coupled to a boundary defining an opening providing access into the container. The seal includes a gripping portion having a fixed end and a free end, the fixed end extending from the body. The free end is sized and shaped to be gripped by a user to enable the user to forcibly disconnect at least a portion of the body from the container. The seal further includes an indicator including an indicator body. A neck portion of the indicator is removably coupled to the gripping portion, such that when the body is at least partially removed from the boundary, at least a portion of the indicator body remains connected to the body, as the gripping portion is disconnected from the indicator when the neck portion is uncoupled from the gripping portion.

In another embodiment, the present disclosure provides a method of manufacturing a tamper evident seal. The method includes forming a tamper-evident seal from a sheet of material. The tamper-evident seal includes a body, a gripping portion, and at least one indicator. The method includes applying a first adhesive to a lower side of the at least one indicator. The method further includes adhering the lower side of the at least one indicator to the body and adhering the body to a boundary of a container.

In yet another embodiment, the present disclosure provides a system for sealing an opening. The system includes a container having a boundary defining the opening which provides access into the container. The system includes a tamper-evident seal. The seal includes a body that is sealably coupled to the boundary. The seal includes a gripping portion having a fixed end and a free end. The fixed end extends from the body. The free end is sized and shaped to be gripped by a user to enable the user to forcibly disconnect at least a portion of the body from the container. The seal further includes an indicator including an indicator body and a neck portion of the indicator is removably coupled to the gripping portion, such that when the body is at least partially removed from the boundary, at least a portion of the indicator body remains connected to the body, as the gripping portion is disconnected from the indicator when the neck portion is uncoupled from the gripping portion.

DETAILED DESCRIPTION OF THE INVENTION

Figure 1:
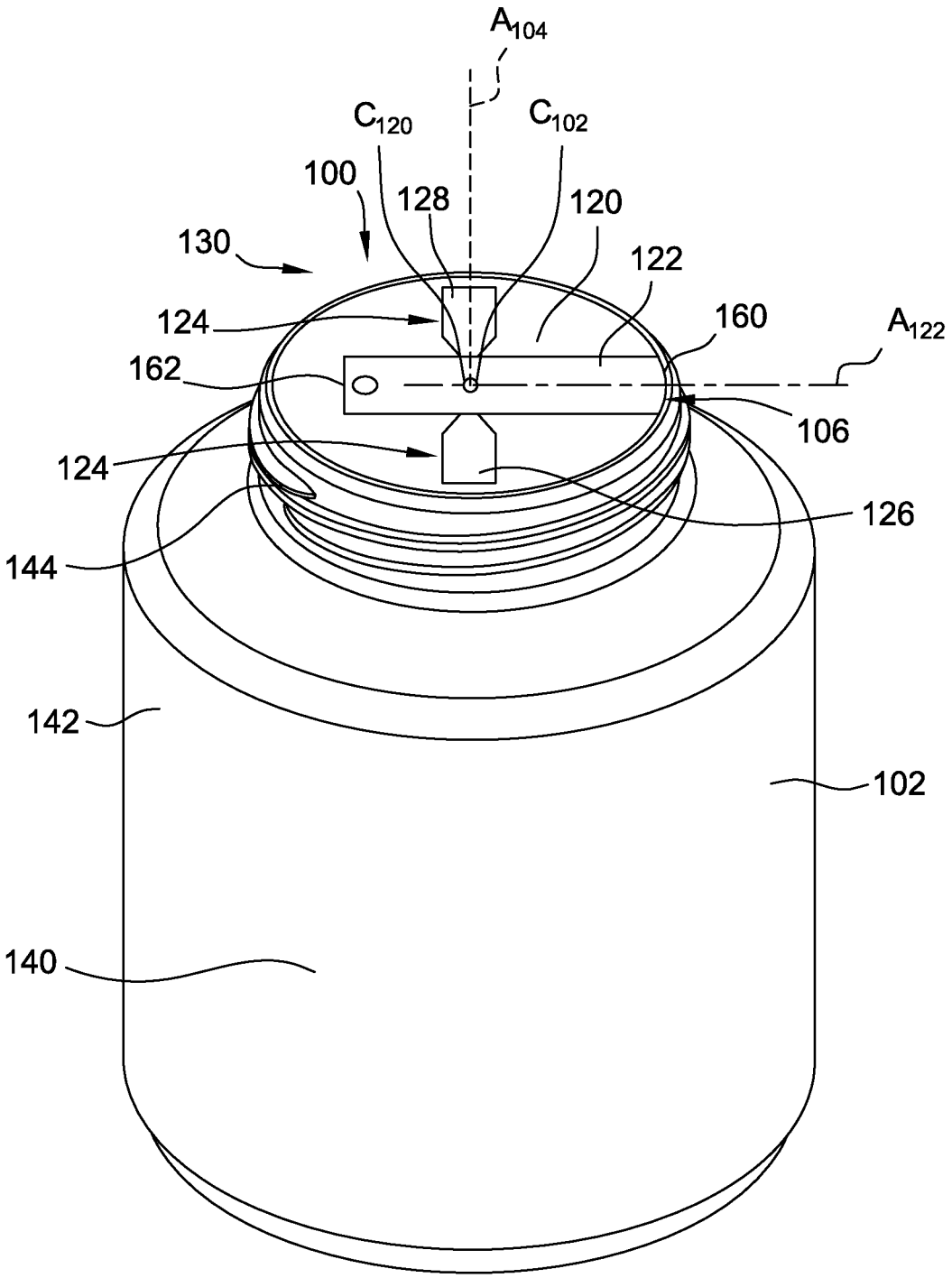
FIG. 1 is a perspective view of an exemplary embodiment of a tamper-evident seal that may be used with a container.

FIG. 1 is a perspective view of an exemplary tamper-evident seal, indicated generally by 100, attached to a container 102 that includes a boundary 104 that defines an opening 106 providing access into an interior 108 (visible in FIG. 3) of the container 102. The seal 100 may be coupled to the boundary 104 to seal the opening 106 of the container 102. The seal 100 provides an indication, e.g., a visual indication, that the seal 100 has been tampered with, i.e., the seal 100 has been removed, partially removed, and/or whether the seal 100 has attempted to be removed from the boundary 104 of the container 102. In the exemplary embodiment, the seal 100 includes a seal body 120, a gripping portion 122, and at least one indicator 124. More specifically, in the exemplary embodiment, the seal 100 includes a pair of indicators 124 including a first indicator 126 and a second indicator 128. As described in more detail herein, a force may be applied to the gripping portion 122 enabling the seal body 120 to be disconnected from the container 102 to remove or partially remove the seal 100 from the container 102. FIG. 1 illustrates the seal 100 in a first orientation 130, prior to the seal 100 being tampered with, and with the gripping portion 122 coupled to the first indicator 126 and the second indicator 128, and the seal body 120 sealably coupled to the boundary 104 such that the seal 100 completely covers the opening 106 to protect contents stored in the container 102 and prevents access into the container 102.

Figure 2:
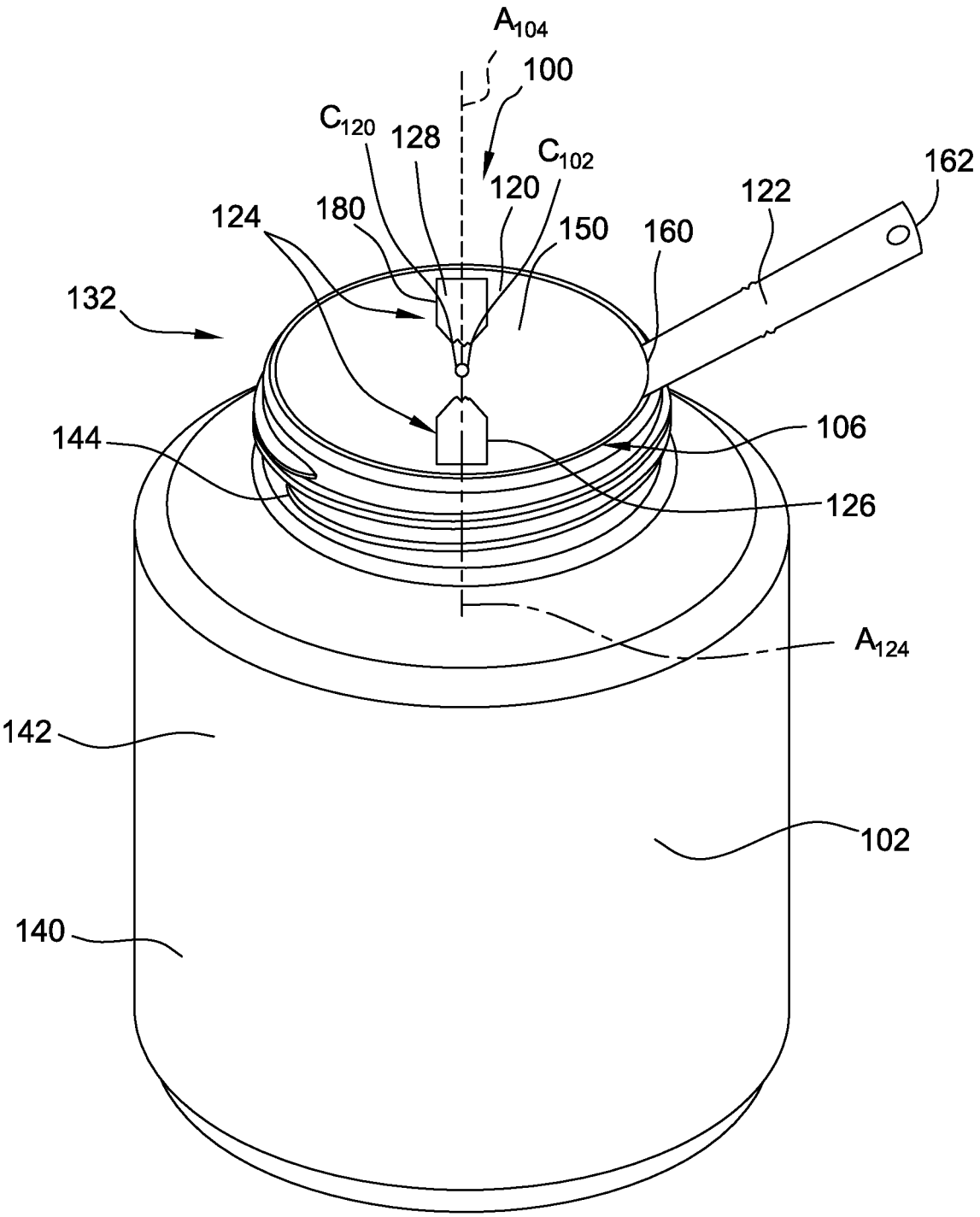
FIG. 2 is a perspective view of the tamper-evident seal shown in FIG. 1 and including a gripping portion that is disconnected from a pair of visual indicators.
Figure 3:
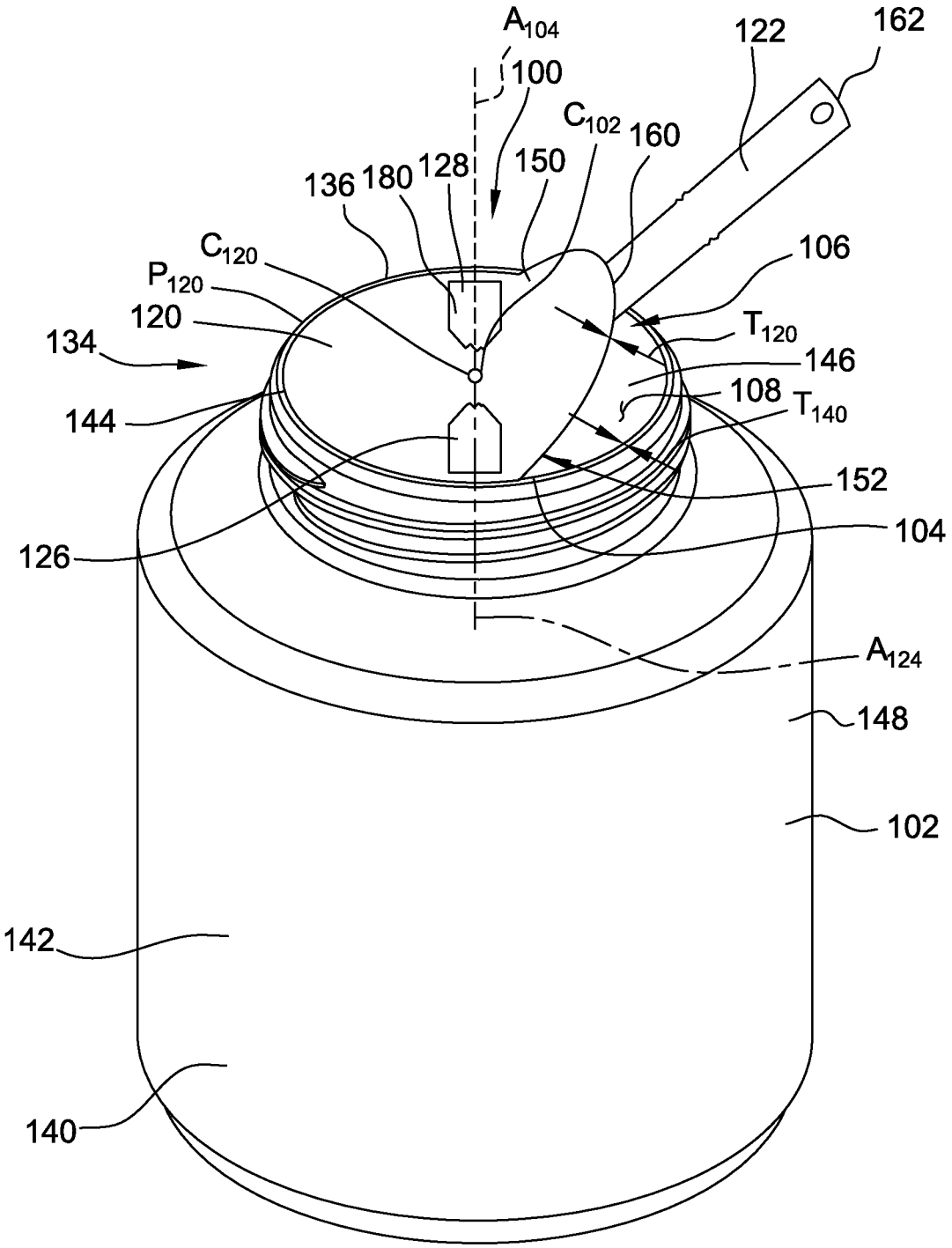
FIG. 3 is a perspective view of the tamper-evident seal shown in FIGS. 1 and 2 and showing the seal body partially removed from the container.

In FIG. 2 the gripping portion 122 is disconnected from the pair of indicators 124. More specifically, in FIG. 2 a pulling force has been exerted on the gripping portion 122 to lift the gripping portion 122 away from the pair of indicators 124. In FIG. 3 the gripping portion 122 is disconnected from the pair of indicators 124 and the seal body 120 is partially removed from the boundary 104 of the container 102. More specifically, in FIG. 3 a pulling force has been exerted to lift the gripping portion 122, causing the gripping portion 122 to be lifted away from the pair of indicators 124, and the pulling force has been induced through the gripping portion 122 to the seal body 120, lifting the seal body 120 away from the boundary 104 of the container 102. FIGS. 2 and 3 illustrate the seal 100 in a second orientation 132 and a third orientation 134, respectively.

In the second orientation 132 and the third orientation 134, the seal 100 has been tampered with. More specifically, in the second orientation 132, see FIG. 2, the gripping portion 122 has been lifted and disconnected from the first indicator 126 and the second indicator 128. Moreover, in the second orientation 132, the seal body 120 may still be sealably coupled to the boundary 104 such that the seal 100 completely covers the opening 106, even though the gripping portion 122 is disconnected from the indicators 124. In the third orientation 134, the gripping portion 122 is disconnected from at least one of the first indicator 126 and the second indicator 128 after a force has been applied to the gripping portion 122 to disconnect the seal body 120 at least partially from the boundary 104, thus providing access to the contents of the container 102. In the second orientation 132 and the third orientation 134, when the gripping portion 122 has been disconnected from the at least one of the first indicator 126 and/or the second indicator 128 a visual indication is provided that the seal 100 has been tampered with. In the exemplary embodiment, the seal body 120, the gripping portion 122, and the pair of indicators 124 are formed integrally, i.e., formed from a single piece having a perimeter 136. In alternative embodiments, the seal body 120, the gripping portion 122, and/or the pair of indicators 124 may be formed separately and independently coupled together using any suitable adhesives and/or attachment mechanisms.

With further reference to FIGS. 1-3, the seal 100 in the exemplary embodiments may be used with any container 102 that includes a wall 140 having a wall body 142 and a neck 144. The neck 144 defines the boundary 104 around the opening 106. The container 102 includes a container axis $A_{104}$ that extends generally through a center $C_{102}$ of the boundary 104. The wall 140 includes an inner surface 146 (visible in FIG. 3) and an opposite outer surface 148. More specifically, the inner surface 146 of the boundary 104 defines the opening 106. Accordingly, the wall 140 has a wall thickness $T_{140}$ measured between the inner surface 146 and the outer surface 148. In some embodiments, the outer surface 148 may include a plurality of threads extending about the neck 144 that are sized to receive complementary threads formed on a cap (not shown) to enable the cap to be securably coupled to the container 102. Alternatively, outer surface 148 may include a plurality of interlocking notches and slots (not shown) that correspond to a plurality of interlocking projections (not shown) that extend from the cap. In a further alternative embodiment, the container 102 may not have threads and/or a cap.

The container 102, shown in FIGS. 1-3, is exemplary only and for illustrative purposes and, as such, it should be understood that the seal 100 may be used to seal any opening of any other type of container having various sizes and shapes. In other words, the size and shape of the seal 100 may be adjusted to enable the seal 100 to be used for a variety of different container opening shapes and/or sizes, without deviating significantly from the present disclosure. For example, the seal 100 may be used with containers having openings that are not defined by a circular boundary. For example, the seal 100 may be used with containers having an opening that is elliptical, square, rectangular, and/or squircle (i.e., a square and/or a rectangle having rounded corners). Accordingly, the seal body 120 may be any shape and size mirroring the shape and/or size of a boundary defining an opening of a container.

With further reference to FIGS. 2 and 3, the seal body 120 includes an upper side 150 and an opposite lower surface 152 (not visible) and a seal body perimeter $P_{120}$. When the seal 100 is secured and sealed to the container 102, the upper side 150 faces outwards from the opening 106, i.e., the upper side 150 is visible to a user when the seal 100 is sealingly coupled to the container 102. The lower surface 152 faces inwardly towards the interior 108 of the container 102 and is not observable unless the seal body 120 is at least partially removed from the container 102. The seal body 120 is sized and shaped to completely cover the opening 106 of the container 102, such that the seal body perimeter $P_{120}$ is generally aligned with the outer surface 158 of the wall 140. Alternatively, the seal body perimeter $P_{120}$ may extend outwardly beyond the boundary 104 of the container 102. In the exemplary embodiment, the seal body 120 has a diameter $D_{120}$, a center $C_{120}$, and a thickness $T_{120}$. The diameter $D_{120}$ may be any suitable size that is variably selected based on a size of the boundary 104 and the opening 106 of the container 102. In the exemplary embodiment, when the seal 100 is sealably coupled to the container 102, e.g., in the first orientation 130, the center $C_{120}$ of the seal body 120 is generally aligned with the center $C_{102}$ and the center axis $A_{104}$ extending through the container 102.

Figure 4:
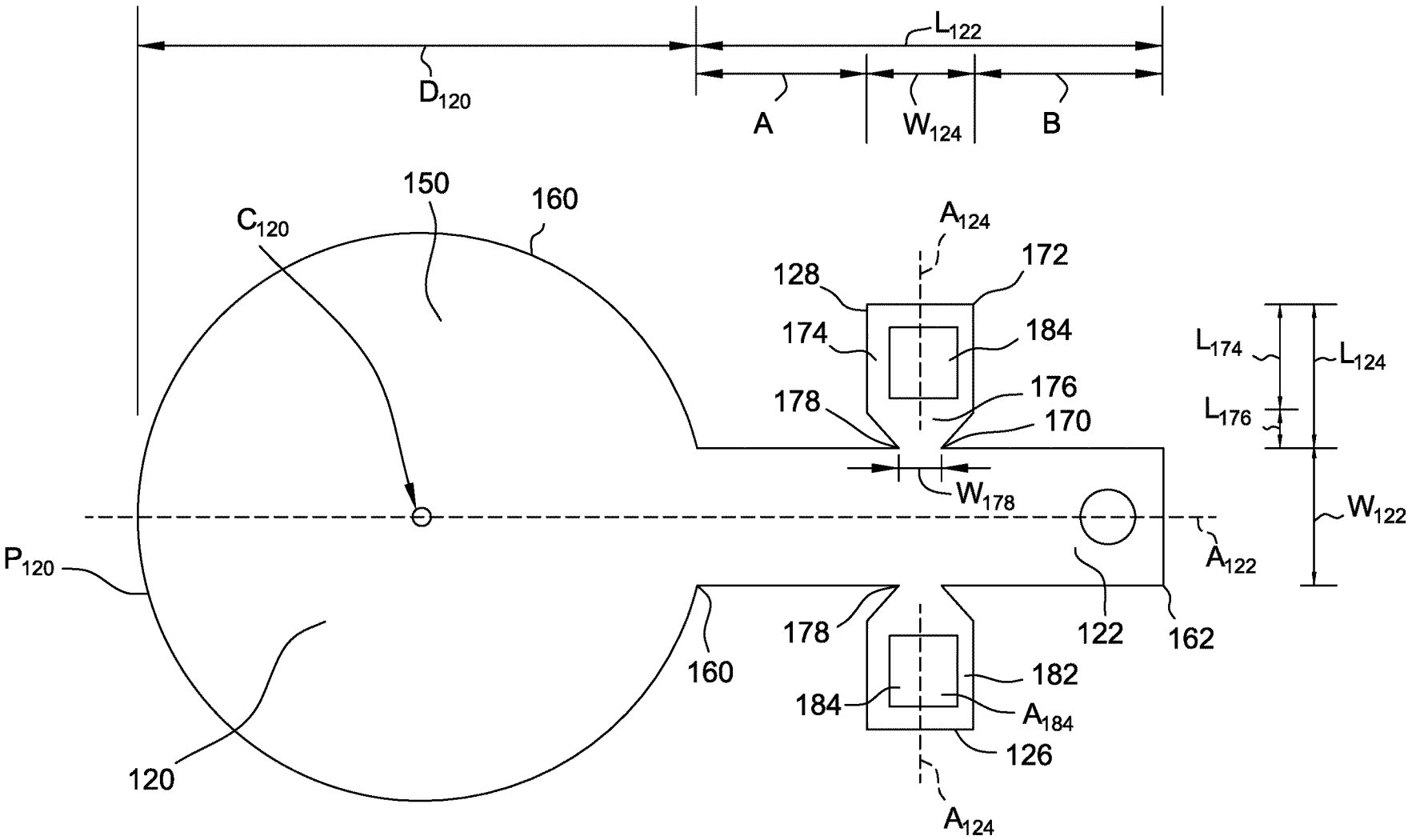
FIG. 4 is a plan view of the tamper-evident seal shown in FIG. 1 and showing the tamper-evident seal prior to being attached to a container.

FIG. 4 is a plan view of the seal 100 shown in FIGS. 1-3, prior to the seal 100 being sealably coupled to the container 102. The gripping portion 122 includes a first end 160, a free end 162 and has a gripping portion 122 axis $A_{122}$ that extends between the first end 160 and the free end 162. The gripping portion 122 has a length $L_{122}$ that extends between the first end 160 and the free end 162 along the gripping portion axis $A_{122}$. In the exemplary embodiment, the first end 160 is formed integrally with the seal body 120, i.e., the seal body 120 and the gripping portion 122 are formed of a single piece at the first end 160. Alternatively, the first end 160 may be coupled to the seal body 120 using any suitable attachments, e.g., adhesives, such that a pulling force exerted on the gripping portion 122 is induced to the seal body 120 to enable the seal body 120 to be removed from the container 102. The gripping portion 122 is sized and shaped to enable a user to grip the gripping portion 122, in proximity to the free end 162, such that a pulling force maybe applied to the gripping portion 122 to assist the user in disconnecting the body 120 from the container 102. In the exemplary embodiment, the gripping portion 122 is generally rectangular and has a length $L_{122}$ and a width $W_{122}$. In alternative embodiments, the gripping portion 122 may have any other shape or size that enables a user to grip the gripping portion 122 and/or that enables the seal 100 to function as described herein.

In some embodiments, the length $L_{122}$ of the gripping portion 122 may be longer than half the diameter $D_{120}$ (i.e., the length $L_{122}$ is longer than a radius of the seal body 120). For example, in some embodiments, the length $L_{122}$ is ¾ of the diameter $D_{120}$. For example, in other embodiments, the length $L_{122}$ is approximately the same length as the diameter $D_{120}$. Alternatively, in some embodiments, the length $L_{122}$ is shorter than ½ the length of the diameter $D_{120}$. In addition, the gripping portion 122 is positioned relative to the seal body 120 such that the gripping portion axis $A_{122}$ passes through the center $C_{120}$ of the seal body 120. Alternatively, the gripping portion 122 may be orientated relative to the seal body 120 such that the gripping portion axis $A_{122}$ extends along a chord of the seal body 120, i.e., a line segment including end points that lie along the seal body perimeter $P_{120}$, of the seal body 120. In other words, in some embodiments the gripping portion axis $A_{122}$ does not extend through the center $C_{120}$. When the seal 100 is sealably secured to the container 102, and the gripping portion 122 is coupled to the first indicator 126 and the second indicator 128, for example when the seal 100 is in the first orientation 130, the gripping portion axis $A_{122}$ intersects, and is generally perpendicular to, the container axis $A_{104}$ FIG. 1.

With further reference to FIG. 4, in the exemplary embodiment, the indicators 124 include a first end 170 and a second end 172, an indicator body 174, and an indicator neck 176. The indicators 124 include an indicator axis $A_{124}$ that extends between the first end 170 and the second end 172. The first end 170 the indicator 124 is formed integrally with the gripping portion 122, i.e., the gripping portion 122 and the indicators 124 may be formed from a single piece of at the first end 170. Alternatively, the indicators 124 may be coupled to the gripping portion 122, e.g., using adhesives. The indicator body 174 extends between the second end 172 and the indicator neck 176, and the indicator neck 176 extends between the indicator body 174 and the first end 170. In the exemplary embodiment, the indicator neck 176 tapers from the indicator body 174, e.g., the indicator neck 176 narrows from the indicator body 174 towards the first end 170.

A tear junction 178 is defined between the first end 170 and the gripping portion 122, at a location where the first end 170 extends from the gripping portion 122. The tear junction 178 is a narrowed and/or tapered portion defined between the gripping portion 122 and the indicator neck 176. Accordingly, in the exemplary embodiment, the tear junction 178 is a tear-able connection, i.e., the gripping portion 122 may be torn from the indicator neck 176 to disconnect the gripping portion 122 from the indicators 124. In other words, a pulling force applied to the gripping portion 122 will cause the gripping portion 122 to tear away from the indicators 124 at the tear junction 178, while the indicator body 174 will remain coupled to the seal body 120. In the exemplary embodiment, the indicator body 174 is generally rectangular in shape. Alternatively, the indicator body 174 may have any other suitable shape. The indicators 124 have an overall length $L_{124}$ extending between the first end 170 and the second end 172. The indicator body 174 has an indicator width $W_{124}$. The indicator neck 176 tapers from the indicator body 174 towards the tear junction 178. The tear junction 178 has a width $W_{178}$ that may be approximately half of the width $W_{124}$. In some embodiments, the width $W_{178}$ may be approximately ¾ the width $W_{124}$. The indicator body 174 has a length $L_{174}$ and the indicator neck 176 has a length $L_{176}$. The length $L_{124}$ is the addition of the length $L_{174}$ and the length $L_{176}$. In some embodiments, the length $L_{176}$ is approximately the same as the length $L_{174}$. In addition, the width $W_{124}$ is approximately twice as wide as the length $L_{122}$. Moreover, the width $W_{122}$ may be approximately the same as the length $L_{124}$. Alternatively, any other dimensions may be use that enable the seal 100 to function as described herein. The gripping portion 122 is sized and shaped such a user may apply a pulling force to the gripping portion 122 to easily remove the seal body 120 from the boundary 104 of the container 102. For example, the size and shape of the gripping portion 122 is selected to minimize the amount of pulling force required to remove the seal body 120 from the boundary 104 of the container 102. Furthermore, the size and shape of the gripping portion 122 is also selected to provide a user with a suitable amount of material that can easily be held between two or more fingers of the user for applying the pulling force. For example, the gripping portion 122 has a suitable length $L_{122}$ and width $W_{122}$ such that a user can place the gripping portion 122 between an index finger and a thumb of the user. As a result, the removal of the seal 100 from the is considered "user-friendly."

In the exemplary embodiment, the pair of indicators 124 are arranged on opposite sides of the gripping portion 122. The indicator axis $A_{124}$ extends generally perpendicularly to the gripping portion axis $A_{122}$. The first indicator 126 and the second indicator 128 are generally aligned and are orientated on opposite sides of the gripping portion 122. In some embodiments, the first indicator includes a first axis and the second indicator includes a second axis, wherein the first indicator and the second indicator are positioned on either side of the gripping portion and the first axis and the second axis are not aligned. In some embodiments, the first indicator 126 and the second indicator 128 extend from the gripping portion 122 a distance A from the seal body perimeter $P_{120}$ of the seal body 120, and a distance B from the free end 162 of the gripping portion 122. In some embodiments, the distance A and the distance B are approximately equal, i.e., the first indicator 126 and the second indicator 128 are each positioned approximately at a halfway point on gripping portion 122. In some embodiments, the distance B is shorter than the distance A such that the indicators 124 are positioned closer to the free end 162 than to the first end 160 of the gripping portion 122. In the exemplary embodiment, the first indicator 126 is positioned directly across the gripping portion 122 from the second indicator 128. In alternative embodiments, the first indicator 126 and the second indicator 128 may be positioned at different locations along the length $L_{122}$ of the gripping portion 122, i.e., the first indicator 126 is not directly disposed across from the gripping portion 122 from the second indicator 128. In some embodiment, e.g., in the first, the second, and/or the third orientations 130, 132, and 134, respectively, the indicators 124 are positioned relative to the seal body 120 such that the indicator axis $A_{124}$ intersects, and is generally perpendicular to, the container axis $A_{104}$. In the exemplary embodiment, the indicator axis $A_{124}$ intersects the center $C_{120}$ of the seal body 120 and the indicator axis $A_{124}$ also intersects the center $C_{102}$.

The seal 100 may include any suitable number of indicators 124, e.g., a single indicator, two indicators 124, and/or three indicators 124, etc. Furthermore, the indicators 124 may be positioned relative to the gripping portion 122 in any suitable orientation that enables the seal 100 to function as described herein. Additionally, the indicators 124 may be any shape and/or size that enables the seal 100 to function as described herein. In the exemplary embodiment, the indicator body 174 is generally square in shape. Alternately, the indicator body 174 may be any other suitable shape, such as, and without limitation, elliptical, square, rectangular, and/or squircle (i.e., a square and/or a rectangle with rounded corners).

In the exemplary embodiment, the indicators 124 include an upper surface 180 and an opposite lower surface 182

(visible in FIG. 4). The lower surface 152 is coupled to the upper side 150 of the seal body 120, e.g., using an adhesive. In other embodiments, the indicator body 174 is coupled to the seal body 120 using any other suitable attachment methods, such as but not limited to stapled, heat sealed, and/or riveted The lower surface of the indicator body 174 includes a contact 184 that is sealed to the seal body 120. In the exemplary embodiment, the contact 184 is substantially the same size and shape as the lower surface 182. In other embodiments, the contact 184 is smaller than a foot print of the indicator body 174. A cross-sectional area $A_{184}$ of the contact 184 and the adhesive used are variably selected to be sure that the indicator body 174 is maintained in as sealed connection to the seal body 120. In other words, the area $A_{184}$ of the contact 184 and the adhesives are suitably sized such that when a pulling force is applied to the gripping portion 122, the gripping portion 122 will disconnect from the indicators 124 as it is torn from the indicators 124, while the indicator body 174 remains coupled to the seal body 120.

Any disconnection, including a partial disconnection, between the gripping portion 122 and at least one of the indicators 124 serves as an indication that the seal 100 has been tampered with, i.e., the seal 100 had been removed, partially removed, and/or an attempt was made to remove the seal 100 from the container 102. Particularly, any disconnection from any of the indicators 124 indicates the gripping portion 122 has been lifted from the seal body 120, and/or pulled on. In the exemplary embodiment, a force needed to disconnect and/or partially disconnect the indicators 124 from the seal body 120 is greater than a force needed to disconnect the gripping portion 122 from the indicators 124. As such, when the gripping portion 122 is lifted, the gripping portion 122 tears, or at least partially tears, from the indicators 124, while the indicator body 174 remains coupled to the seal body 120.

Alternatively, in some embodiments, the gripping portion 122 may be lifted while the indicators 124 remain coupled to the gripping portion 122 and are disconnected from the seal body 120, i.e., as a force applied to the gripping portion 122 breaks the connection between the lower surface 152 of the indicators 124 and the seal body 120. In this alternative embodiment, the disconnection between the indicator body and the body provides an indication that the seal 100 has been tampered with.

The seal 100, including the seal body 120, the gripping portion 122, and the indicators 124 may be fabricated from of any suitable material and/or materials. In the exemplary embodiment, the seal body 120, the gripping portion 122, and the one or more indicators 124 are all formed from a single unitary piece and are all fabricated of the same material. In alternative embodiments, the seal body 120, the gripping portion 122, and the one or more indicators 124 may each be formed of different material. Additionally, in some embodiments, the seal body 120, gripping portion 122, and/or the indicators 124 may be formed from the same material but have different thicknesses. In one embodiment, the seal 100 is fabricated from aluminum. Alternatively, seal 100 may be fabricated from any other material that enables the opening 106 of the container 102 to be sealed such that contaminants are prevented from entering container 102 while providing a visual indication that the container 102 has been opened, For example, Seal 100 may be fabricated from, but not limited to being formed from a foil, a material membrane, a cellophane, a plastic material, and/or heat shrinkable plastic material.

In one embodiment, container 102 may contain household products including, but not limited to, products including chemicals, paints, products, alcohol, cleaning solutions, glues, toxins, and/or lawn products. In another embodiment, container 102 may contain automotive products including, but not limited to, antifreeze, solvents, cleaning products, or petroleum products. In a further embodiment, container 102 may contain pharmaceutical products. In yet another embodiment, container 102 may contain consumable products including potable fluids, condiments, milk, juice, or yogurts and the like. In yet a further embodiment, container 102 may contain military or industrial products.

In yet another embodiment, container 102 may contain medical devices, such as, for example, implants, including, but not limited to, heart valves, orthopedic implants, medical devices, pacemakers and the like. A container 102 used to contain and store medical device may require sealed packaging in order to maintain sterilized conditions within the container 102. In yet another embodiment, the container 102 may be used to store evidence for forensic investigations. For such embodiments, storage of forensic evidence requires tamper-evident seals that prevents evidence tampering. Accordingly, a tamper-evident seal may be used to sealably couple the opening 106 of a container 102, to protect the contents therein from external contamination. Accordingly, the tamper-evident seal 100 described herein is particularly useful for storing and protecting contents that require additional safety precautions. The seal 100 may be used with any suitable container 102 including contents stored therein that need to be protected while providing an indication that the container has been tampered with.

Figure 5:
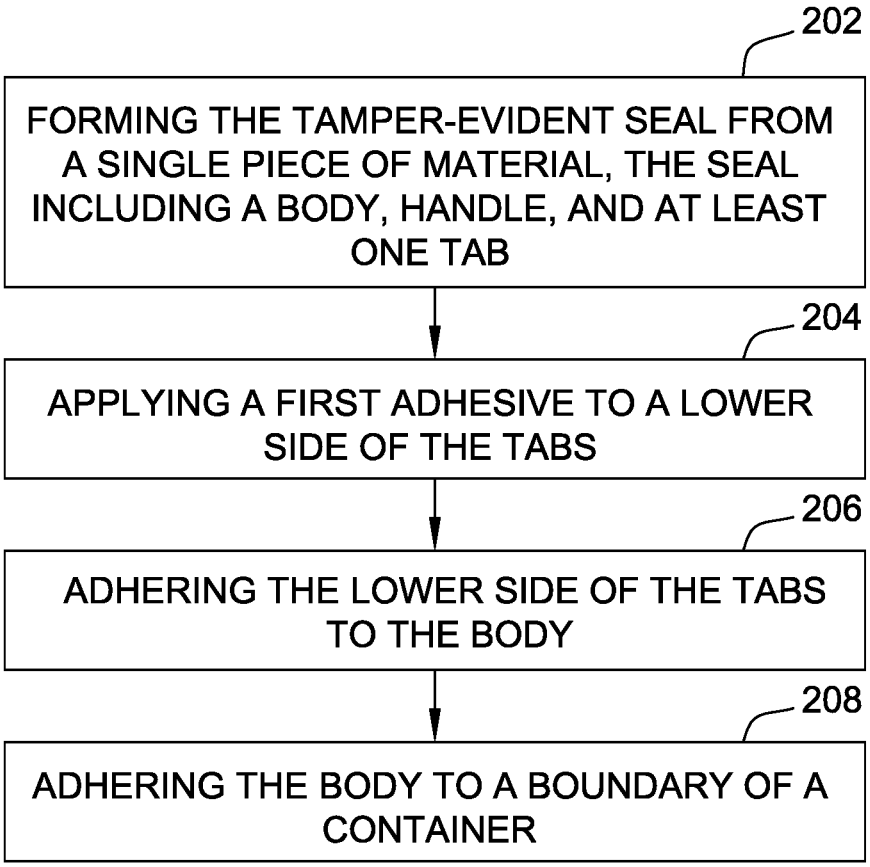
FIG. 5 is an exemplary method of manufacturing a tamper evident seal, such as the seal shown in FIGS. 1-5.

FIG. 5 is an exemplary method 200 of manufacturing a tamper proof seal, such as the seal 100. In the exemplary embodiment, the method 200 includes forming 202 the seal 100 from a sheet of material (not shown). More specifically, forming 202 the seal 100 may include using a stamping process that uses a cutter (not shown) having a cutting edge formed in the shape of the perimeter 136 of the seal 100, best shown in FIG. 4. The cutter may be used to cut out a plurality of seals 100 from the sheet of material. The sheet of material may be fabricated from any suitable material, as described above. In some embodiments, as the seal 100 is formed 202 a weakened connection between the gripping portion 122 and the indicators 124 may also be formed. For example, in some embodiments, as the seal is formed 202 the cutter may be used to create a perforated boundary at the tear junction 178 between the first end 170 of the indicators 124 and the gripping portion 122. The perforated boundary may include a plurality of tiny gaps between the gripping portion 122 and the indicators 124. In some embodiments, the weakened connection between the gripping portion 122 and the indicators 124 is a narrowed connection, i.e., the indicator neck 176.

The method 200 includes applying 204 an adhesive to the contact 184 on the lower surface 152. In some embodiments, the adhesive may be applied to the upper side 150 of the seal body 120. The adhesive is used to connect the indicators 124 to the seal body 120.

The method 200 includes adhering 206 the contact 184, coated with the applied 204 adhesive to the seal body 120, such that the indicators 124 are coupled to the seal body 120. Adhering 206 the contact 184 of the indicator 124 to the seal body 120 includes folding the gripping portion 122 at the first end 160 such that the free end 162 is disposed in proximity to the seal body 120. Folding the gripping portion 122 at the first end 160 positions the contact 184, coated with the adhesive, into contact with the upper side 150 of the seal body 120.

In the exemplary embodiment, the method 200 includes adhering 208 the seal body 120 to the boundary 104 of the container 102, such that the seal body 120 is sealably coupled to the boundary 104. Adhering 208 the seal body 120 to the boundary 104 may include applying an adhesive to the seal body 120, to adhere the seal body 120 to the boundary 104. In other embodiments, adhering 208 the seal body 120 to the boundary 104 may include the application of heat.

In other embodiments, the method includes adhering 208 the seal body 120 to the boundary of the container and then subsequently, adhering the contact 184 to the seal body 120.

Figure 6:
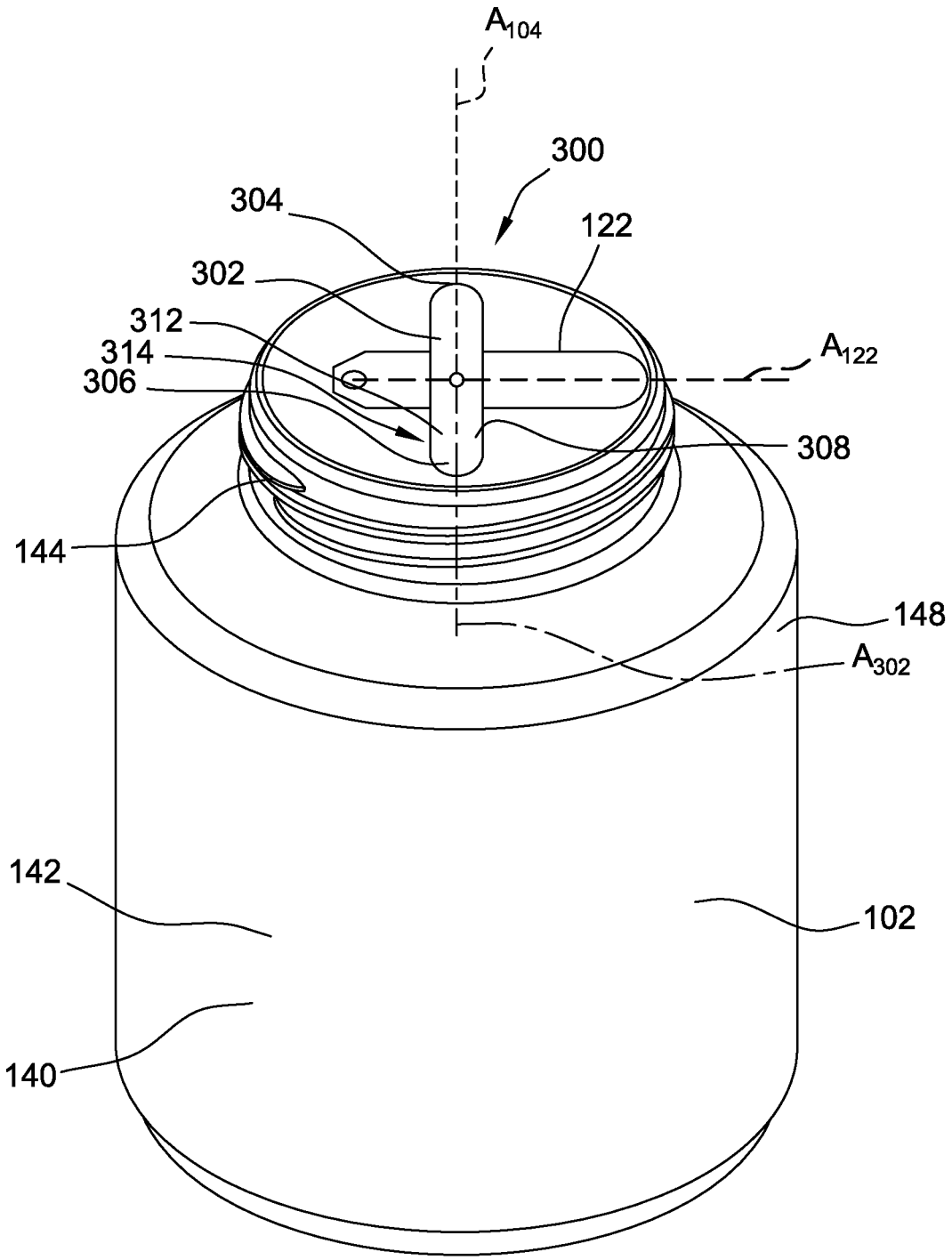
FIG. 6 is a perspective view of another exemplary embodiment of a tamper-evident seal that may be used with a container.
Figure 7:
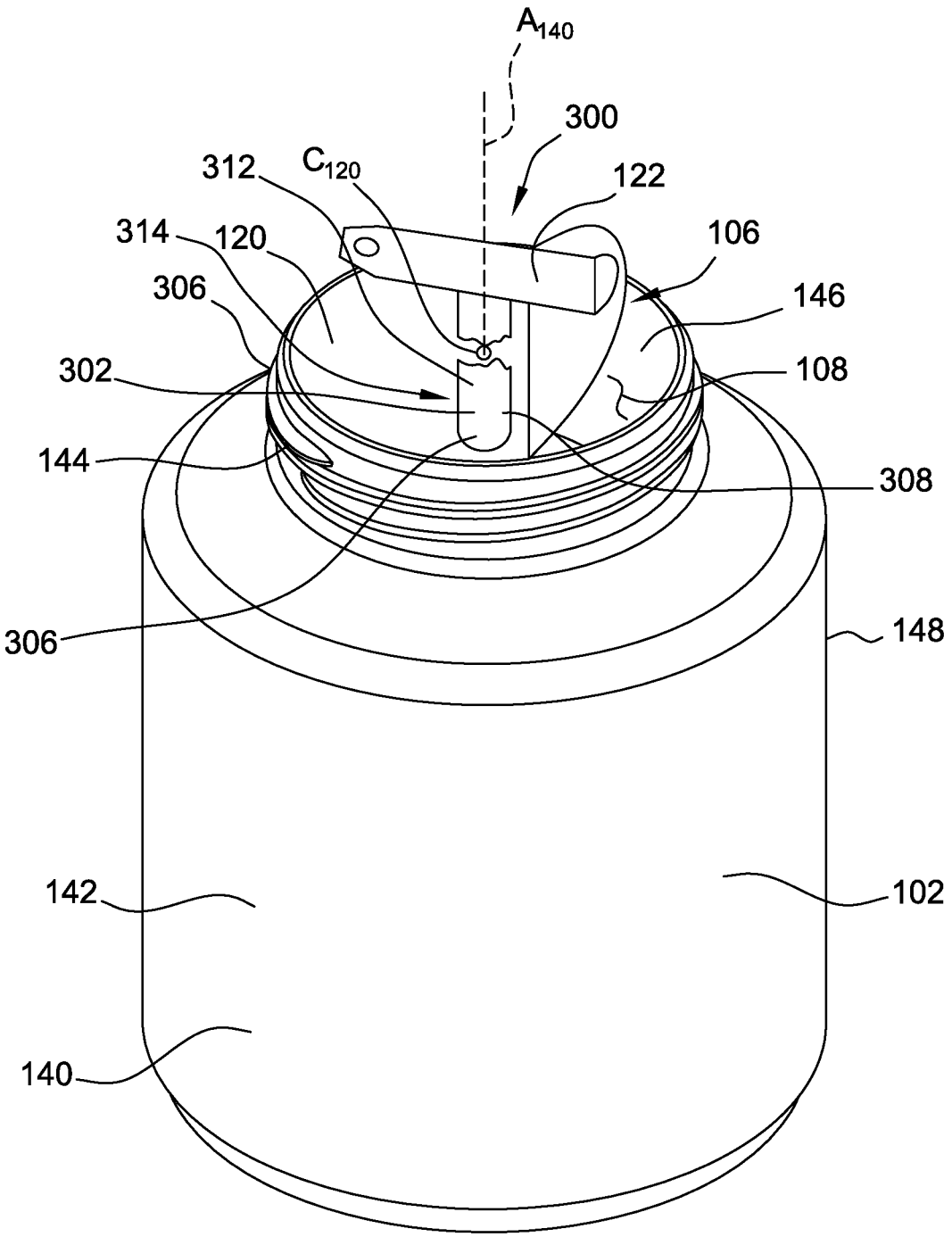
FIG. 7 is a perspective view of the tamper-evident seal shown in FIG. 6 and showing a gripping portion disconnected from the indicator, and the seal partially removed from the container.

FIGS. 6-7 shows another exemplary embodiment of a tamper-evident seal, indicated generally by 300. Similar to seal 100, the seal 300 includes a gripping portion 122 and a seal body 220 formed of a single unitary piece. The seal 300 includes an indicator 302, having an indicator axis $A_{302}$, that is formed separately from the seal body 220 and the gripping portion 122. As described above, in reference to seal body 120, the seal body 220 is sized and shaped to seal and cover the opening 106 of the container 102 when the seal body 120 is sealably coupled to the boundary 104. In addition, and as describe above in reference to the gripping portion 122, the gripping portion 122 includes a first end 160 and a free end 162, the first end 160 is formed integrally with the seal body 120. The free end 162 is not coupled to the seal body 120. Similar to seal 100, the gripping portion 122 of seal 300 may be used to pull the seal body 120 from the boundary 104 of the container 102.

The indicator 302 includes a first end 304 and a second end 306, each coupled to the seal body 120, and a body 308 extending between the first end 304 and the second end 306. The indicator 302 includes a first side 312 and second side 314 (not visible), at least a portion of the second side 314 may be coated with a suitable adhesive, such that the first side 312 of the indicator 302 may be adhered to the seal body 120. The seal body 120 may be sealably coupled to the boundary 104 of the container 102, using any suitable adhesives. The gripping portion 122 may be folded at the first end 160, such that the free end 162 is placed into proximity to the upper side 150 of the seal body 120. Subsequently, the indicator 302 maybe placed over the gripping portion 122 such that the first side 312, coated with adhesive, is positioned into contact with the upper side 150 of the seal body 120 on either sides of the gripping portion 122. Accordingly, the gripping portion 122 is captured between the indicator 301 and the seal body 120. When a force is applied to the gripping portion 122, the gripping portion 122 is pulled through the indicator 302 tearing the indicator 302. Accordingly, the torn indicator 302 serves as an indication that the seal 300 has been tampered with.

Embodiments of the tamper-evident seal described above have advantages over conventional tamper evident seals. For example, the tamper-evident seals described herein provides an indication of whether the tamper-evident seals has been tampered with, i.e., removed, partially removed and attempted to be removed. Stated another way, a user may attempt to access the contents of a container, sealed with the tamper-evident indicator, by applying a force on the gripping portion that is induced to the body to remove the body from a boundary of the container. Lifting of the gripping portion, causes visible and/or tactile damage to the indicator, serving as an indication that someone has attempted to remove the seal.

In some embodiments, the indicator may include a sealed pouch that contains a dye therein. The pouch is sealed, storing the dye therein, when the indicator is coupled to the gripping portion. When the gripping portion is torn from the indicators, the pouch opening releasing the dye and staining the area surrounding the seal. For example, when a user lifts the gripping portion, tearing the indicators from the gripping portion, may stain the hands of the user, stain the seal body, the gripping portion, and/or the indicators. In some embodiments, the pouch may contain other materials that provide an olfactory indicator, i.e., a scent to the user that the seal has been tampered with. Additionally, and/or alternatively, the seal 100 may indicate to a person that the seal has been tampered by providing an indication including visual, tactile, olfactory, and/or audible indicators.

Furthermore, embodiments of the tamper-evident seal cannot be returned to an initial configuration, i.e., the first orientation 130, to conceal the fact that the tamper-evident seal has been tampered with, i.e., the indicators cannot be reconnected to the gripping portion after the gripping portion has been torn from the indicators and/or the indicators have been torn. For example, in some known conventional tamper seals, a gripping portion may be used to detached a seal from a container, and subsequently, the seal may be glued back to the boundary of the container, with limited indication that the seal has been tampered with. In contrast, the embodiments described above, the torn indicators and/or torn gripping portion cannot be reconnected.

What is claimed is:

1. A tamper-evident seal for use with a container, the tamper-evident seal comprising:

a body sealably coupled to a boundary defining an opening;

a gripping portion having a fixed end and a free end, the fixed end extending from the body, the gripping portion including a first surface and an opposite second surface, wherein the free end is sized and shaped to be gripped by a user to enable the user to forcibly disconnect at least a portion of the body from the boundary; and an indicator including an indicator body including a lower surface adhered to the body and an exposed upper surface that opposes the lower surface, a neck portion of the indicator is removably coupled to the gripping portion and extends from a side edge of the gripping portion, wherein when the indicator is connected to the gripping portion, the indicator upper and lower surfaces are generally parallel to the gripping portion first and second surfaces, such that when the gripping portion is lifted away from the body, at least a portion of the indicator body remains connected to the body, and wherein the body, the gripping portion, and the indicator are formed of a single unitary piece.

2. The tamper-evident seal in accordance with claim 1, wherein the indicator includes at least one of a first indicator and a second indicator.

3. The tamper-evident seal in accordance with claim 1, wherein the gripping portion includes a gripping portion length extending from the fixed end to the free end, and the body includes a diameter, wherein the gripping portion length is longer than ½ the diameter.

4. The tamper-evident seal in accordance with claim 1, wherein the indicator includes a first end and a second end, the first end formed integrally with the gripping portion, wherein the indicator body extends from the second end to the indicator neck and the indicator neck extends from the indicator body to the first end, wherein the indicator neck narrows from the indicator body to the first end.

5. The tamper-evident seal in accordance with claim 4, wherein a tear junction between the first end of the indicator and the gripping portion is at least one of a narrowed or perforated connection, such that the gripping portion may be torn from the first end of the indicator.

6. The tamper-evident seal in accordance with claim 5, wherein the tear junction includes a tear junction width and the indicator body includes an indicator body width, wherein the tear junction width is approximately ¾ the indicator body width.

7. The tamper-evident seal in accordance with claim 6, wherein the indicator includes an indicator axis extending between the first end and the second end, wherein the indicators are disposed such that the indicator axis intersects with a container axis extending through a center of the opening.

8. The tamper-evident seal in accordance with claim 2, the first indicator includes a first axis and the second indicator includes a second axis, wherein the first indicator and the second indicator are disposed on either side of the gripping portion and the first axis and the second axis are aligned.

9. The tamper-evident seal in accordance with claim 2, the first indicator includes a first axis and the second indicator includes a second axis, wherein the first indicator and the second indicator are disposed on either side of the gripping portion and the first axis and the second axis are not aligned.

10. A method of manufacturing a tamper evident seal, wherein the method comprises:

forming a tamper-evident seal from a sheet of material, the tamper-evident seal including a body, a gripping portion, and at least one indicator extending from an edge of the gripping portion, wherein the body, the gripping portion, and the indicator are formed of a single unitary piece;

applying a first adhesive to a lower side of the at least one indicator;

adhering the lower side of the at least one indicator to the body; and adhering the body to a boundary of a container.

11. The method of claim 10, wherein the gripping portion includes a first end coupled to the body and a free end, wherein adhering the lower side of the at least one indicator to the body further comprises folding the gripping portion at the first end such that the free end is disposed in proximity to the body and the lower side of the indicator body is in contact with the body.

12. A system for sealing an opening; wherein the system includes:

a container having a boundary defining an opening providing access into the container; and a tamper-evident seal comprising:

a body sealably coupled to the boundary;

a gripping portion having a fixed end and a free end, the fixed end extending from the body, the gripping portion including a first surface and an opposite second surface, wherein the free end is sized and shaped to be gripped by a user to enable the user to forcibly disconnect at least a portion of the body from the container; and an indicator including an indicator body including a lower surface adhered to the body and an exposed upper surface that opposes the lower surface, a neck portion of the indicator is removably coupled to the gripping portion and extending from a side edge of the gripping portion, wherein when the indicator is connected to the gripping portion, the indicator upper and lower surfaces are generally parallel to the gripping portion first and second surfaces, such that when the gripping portion is lifted away from the body, at least a portion of the indicator body remains connected to the body, and wherein the body, the gripping portion, and the indicator are formed of a single unitary piece.

13. The system in accordance with claim 12, wherein the indicator includes a first indicator and a second indicator.

14. The system in accordance with claim 12, wherein the gripping portion includes a gripping portion length extending from the fixed end to the free end, and the body includes a diameter, wherein the gripping portion length is longer than ½ the diameter.

15. The system in accordance with claim 12, wherein the indicator includes a first end and a second end, the first end formed integrally with the gripping portion, wherein the indicator body extends from the second end to the indicator neck and the indicator neck extends from the indicator body to the first end, wherein the indicator neck narrows from the indicator body to the first end.

16. The system in accordance with claim 12, wherein a tear junction between the first end of the indicator and the gripping portion is at least one of a narrowed or perforated connection, such that the gripping portion may be torn from the first end of the indicator.

* * * * *